US009410295B2

(12) United States Patent
Schulze et al.

(10) Patent No.: US 9,410,295 B2
(45) Date of Patent: Aug. 9, 2016

(54) RAIL SYSTEM, IN PARTICULAR FOR AN IN-FLOOR ELECTRIC CONVEYER SYSTEM

(75) Inventors: Herbert Schulze, Aidlingen (DE); Peter Obstfelder, Starzach (DE)

(73) Assignee: EISENMANN AG, Boeblingen (DE)

( * ) Notice: Subject to any disclaimer, the term of this patent is extended or adjusted under 35 U.S.C. 154(b) by 0 days.

(21) Appl. No.: 14/007,710

(22) PCT Filed: Mar. 8, 2012

(86) PCT No.: PCT/EP2012/001025

§ 371 (c)(1),
(2), (4) Date: Sep. 26, 2013

(87) PCT Pub. No.: WO2012/136298

PCT Pub. Date: Oct. 11, 2012

(65) Prior Publication Data

US 2014/0021305 A1 Jan. 23, 2014

(30) Foreign Application Priority Data

Apr. 7, 2011 (DE) ..... 10 2011 016 349

(51) Int. Cl.
*E01B 7/08* (2006.01)
*E01B 25/00* (2006.01)
*E01B 23/06* (2006.01)

(52) U.S. Cl.
CPC ..... *E01B 23/06* (2013.01)

(58) Field of Classification Search
CPC ..... E01B 7/00; E01B 7/18; E01B 7/20; E01B 7/22; E01B 7/28; E01B 7/30; E01B 11/00; E01B 11/42
USPC ..... 104/130.01, 130.07, 130.11; 246/415 R, 246/416, 429, 430, 434
See application file for complete search history.

(56) References Cited

U.S. PATENT DOCUMENTS 4,005,839 A * 2/1977 Frank ..... E01B 7/00 246/415 R
5,219,395 A * 6/1993 Spieldiener ..... E01B 25/12 104/102
8,051,777 B2 11/2011 Weissbrodt
8,302,536 B1 11/2012 Meinzinger

FOREIGN PATENT DOCUMENTS

WO 92/03616 3/1992

* cited by examiner

*Primary Examiner* — R. J. McCarry, Jr.
(74) *Attorney, Agent, or Firm* — Factor Intellectual Property Law Group, Ltd.

(57) ABSTRACT

A rail system for an in-floor electric conveyer system having a main track with at least two fixed parallel rails, at least two secondary tracks which enclose an angle and each have fixed rails, and a switch arranged between the main track and the secondary tracks. Each rail of the main track is assigned a moveable rail section connected to the corresponding rail of the main track via a joint. Each joint has at least one end face of the rail of the main track embodied as part of a rotational face about the axis of a pivot pin, at least one end face, embodied in a complementary fashion thereto, of the assigned movable rail section and at least one transition body, which overlaps the fixed rail and the movable rail section and is connected in one end region to the fixed rail, and in the other end region to the movable rail section in an articulated fashion.

12 Claims, 5 Drawing Sheets

RAIL SYSTEM, IN PARTICULAR FOR AN IN-FLOOR ELECTRIC CONVEYER SYSTEM

RELATED APPLICATIONS

This application is a national phase of International Application No. PCT/EP2012/001025 filed on Mar. 8, 2012, which claims the filing benefit of German Patent Application No. 10 2011 016 349.2 filed on Apr. 7, 2011, the contents of both of which are herein incorporated by reference.

FIELD OF THE INVENTION

The invention relates to a rail system, in particular for an in-floor electric conveyor system, having a) a main track, which comprises at least two fixed parallel rails;

b) at least two secondary tracks which enclose an angle and each have as many fixed rails as the main track;

c) a switch which is arranged between the main track and the secondary tracks and comprises:

ca) a movable rail section for each rail of the main track, which is capable of forming at least part of the connection between the rail of the main track and a rail of the secondary track in one position;

cb) at least one actuating mechanism for moving the movable rail sections.

Whereas the earlier prior art saw the frequent use of switches which made it necessary for the vehicle travelling over the switch to stop on the switch during the changeover, more recent times have seen an increase in the use of continuously operating switches, where the vehicle can travel over the switch without stopping. The advantages of such continuously operating switches are obvious: the throughput of vehicles through the rail system is greater since no time is required for braking, stopping and re-accelerating the vehicle in the region of the switches.

A continuously operating switch of the type mentioned at the outset is described in DE 20 2008 010 439 U1. Here, each rail of the main track is associated with as many movable rail sections as there are secondary tracks. These movable rail sections are displaced linearly in order to close the gaps between the corresponding rails after the desired connection between the main track and a secondary track. However, this involves a relatively high structural expenditure and spatial requirement. Only relatively long response times of the switch are possible due to the sluggishness of the system. This reduces the throughput through the rail system.

A further continuously operating switch is disclosed in DE 20 2008 016 678 U1. This likewise calls for as many movable rail sections for each rail of the main track as there are secondary tracks. These movable rail sections are arranged on a turntable here and are all rotated together about a centre of rotation. However, the overall height of a construction of this type is considerable and, in many cases, requires an inherently undesirable pit. Moreover, the structural expenditure is to all intents and purposes comparable to that required for the rail system of DE 20 2008 010439 U1.

An object of the present invention is to construct a rail system of the type mentioned at the outset so as to reduce the structural expenditure, whilst taking particular care that the lateral guide faces of the rails also have no abrupt changes of direction in the region of the switch.

SUMMARY OF THE INVENTION

This object may be achieved according to the invention in that d) each rail of the main track has a single movable rail section associated therewith, which is permanently physically connected to the corresponding rail of the main track via a joint and can be optionally connected to a fixed rail of each secondary track through a pivotal movement about this joint;

wherein e) each joint comprises ea) at least one end face of the rail of the main track, which is constructed as part of a rotational face about the axis of a pivot pin;

eb) at least one end face of the movable rail section, which abuts against the end face of the fixed rail and is shaped in a complementary manner thereto;

ec) at least one transition body which overlaps the fixed rail and the movable rail section and is connected in one end region to the fixed rail and in the other end region to the movable rail section in articulated manner, wherein at least one end face of the transition body realises a contour-adapted transition between the fixed rail and the movable rail section in at least one position of the movable rail section.

According to the invention, and contrary to the prior art, it is no longer the case that, for each path producing a connection between a rail of the main track and the associated rails of the different secondary tracks, a distinct movable rail section is provided which is moved into the corresponding position upon adjustment of the switch. Instead, according to the invention, only a single movable rail section, which can be optionally connected to a rail of each secondary track through a pivotal movement about a joint, is used for each rail of the main track. This means that the number of movable rail sections required is considerably lower, which not only considerably reduces the costs but also the dimensions of a rail system of this type. The above-mentioned secondary condition, that the guide face of the different rails should have no abrupt changes of direction, is ensured by the special construction of the joints which connect the rails of the main track respectively to the associated movable rail sections. The transition body provided in these joints ensures that the transition between the lateral guide faces of the rails of the main track and the lateral guide faces of the movable rail section is made smoother in at least one position of the movable rail section.

Expediently, the rotational faces on the end regions of the fixed rails and the movable rail sections are the lateral faces of a circular cylinder or a right circular cone.

It is the norm with switches that at least some of the connecting paths between rails of the main track and rails of the secondary tracks cross. Gaps have to be provided at the crossing points in these connecting paths, which can be closed by a further movable rail section to produce the desired connection. In the prior art, this often occurs through a linear displacement of a plurality of movable rail sections or by rotating a single movable rail section about an axis located in its centre.

According to the invention, it is preferred if the gap-closing further movable rail section is rigidly connected to one of the movable rail sections, which is connected to a rail of the main track via a joint. In this case, the synchronism of the movements of the different movable rail sections is ensured without complex control means. It is optionally possible to dispense with a separate actuating mechanism for moving this further movable rail section.

It is generally favourable if all movable rail sections can be moved by way of a single actuating mechanism. Again, the reason for this is the reduction in structural and control-related expenditure.

The present invention is particularly suitable for such rail systems as those in which lines for supplying power to the vehicles traveling on the rail system and/or for transmitting signals from and/or to the vehicle are provided along at least one of the rails of the main track, along the movable rail section associated with this main track and along at least one rail of each secondary track. It is particularly favourable here that there is a continuous physical connection between the rails of the main track and the movable rail sections associated with this main track and there is no occurrence of relatively large gaps or breaks, as was the case in the prior art.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention is explained in more detail below with reference to the drawing, which shows.

DETAILED DESCRIPTION OF THE PRESENT INVENTION

Figure 1:
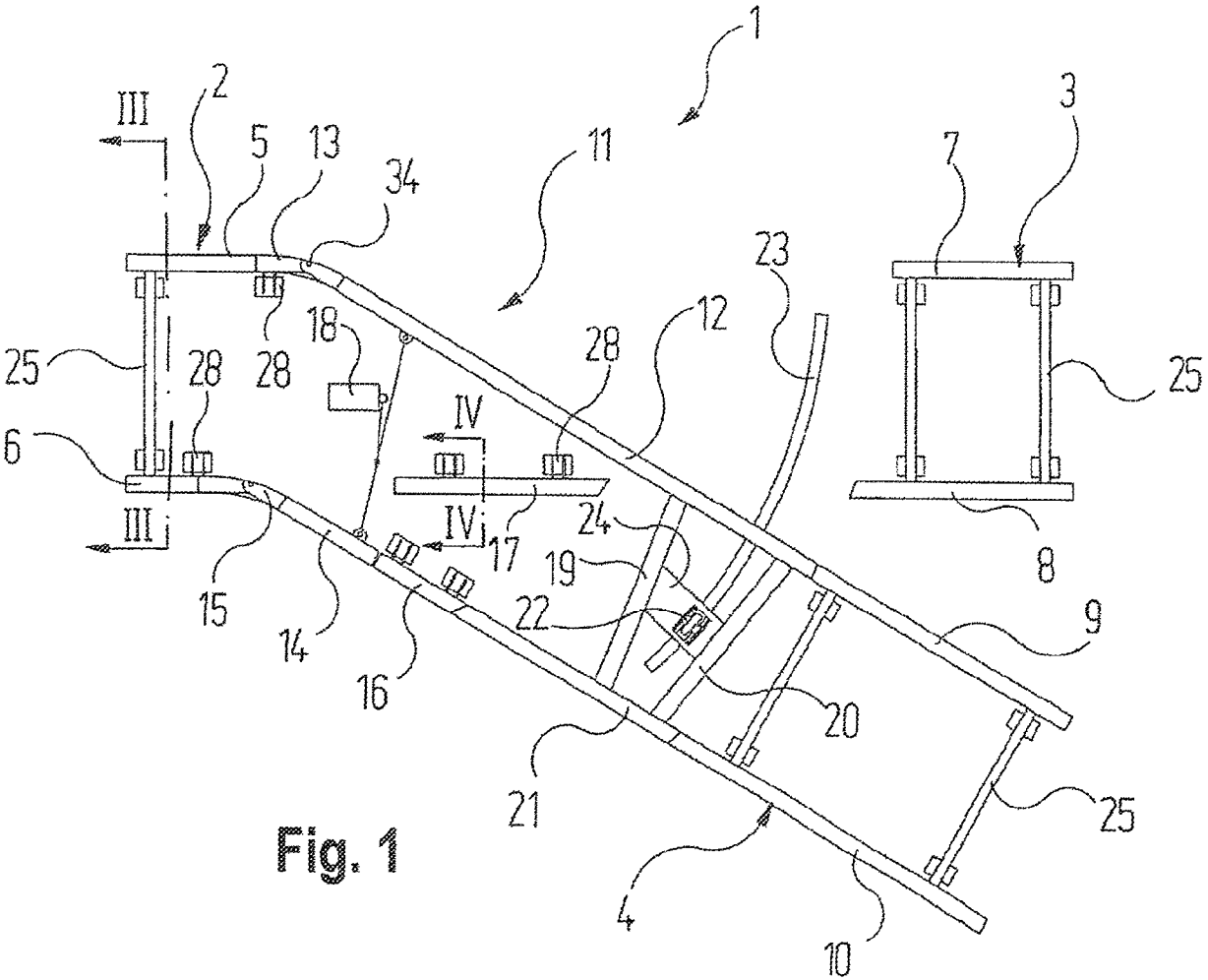
FIG. 1 the plan view of a rail system with a switch in a first switch position.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
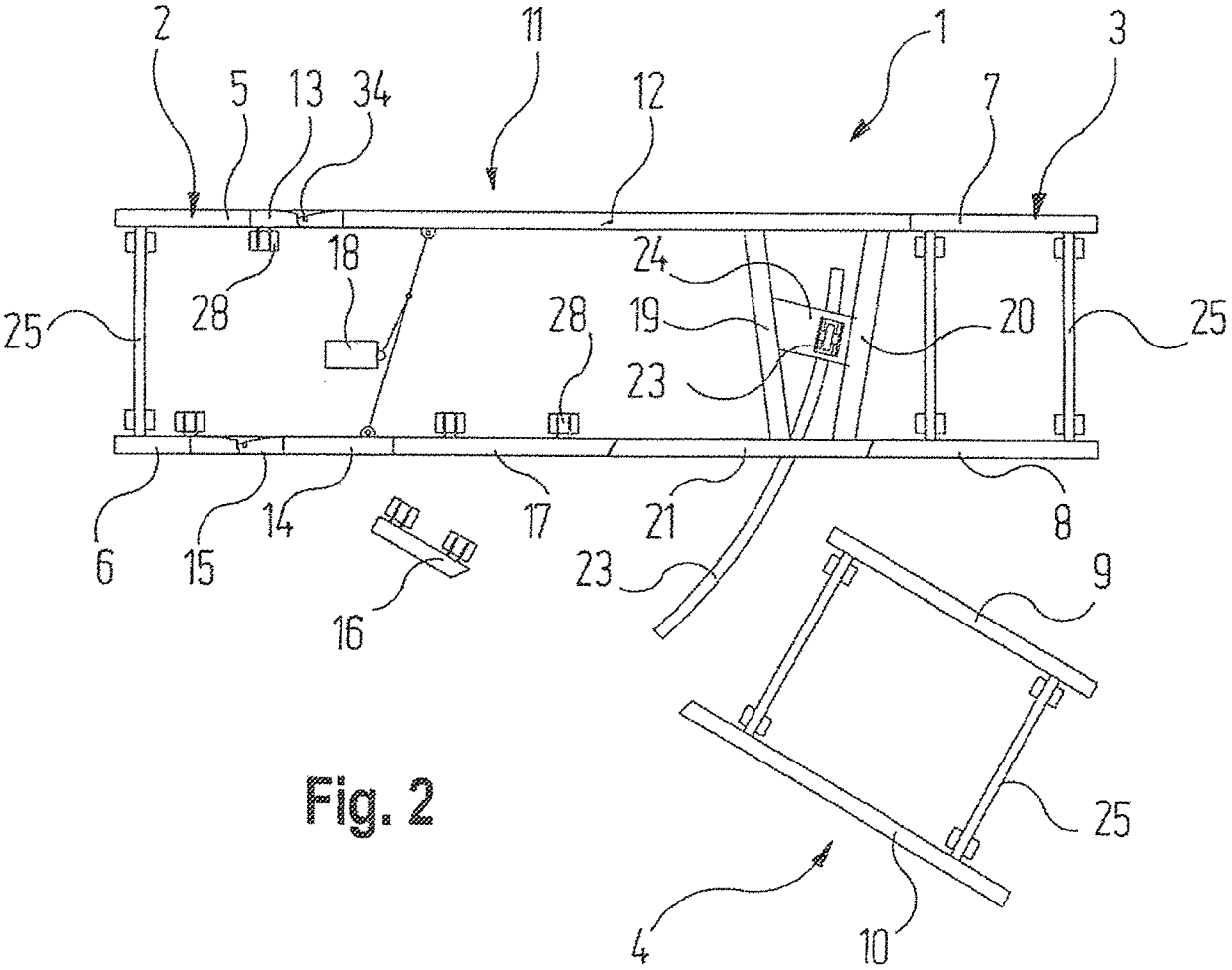
FIG. 2 the plan view of the rail system of FIG. 1 in the other switch position.

Reference is firstly made to FIGS. 1 and 2, in which a rail system is shown which is denoted as a whole by the reference numeral 1 and comprises a main track 2 and two secondary tracks 3, 4 in the section shown. Each track 2, 3, 4 comprises two parallel rails 5, 6 and 7, 8 and 9, 10. The tracks 2, 3 and 4 and therefore also the rails 5, 6, 7, 8, 9, 10 are fixed. Whilst the secondary track 3 is located in the linear continuation of the main track 2, the secondary track 4 branches off at a particular angle from the other secondary track 3.

The main track 2 can optionally be connected to the secondary track 3 or the secondary track 4 with the aid of a switch, which is denoted as a whole by the reference numeral 11. The switch 11 comprises a pivotable rail section 12 with which the rail 5 is associated, and a pivotable rail section 14 with which the rail 6 is associated. The rail section 12 here is connected to the rail 5 via a first joint 13 and the rail section 14 is connected to the rail 6 via a second joint 15. The precise construction of these joints 13, 15 is described further below.

The length of the pivotable rail section 12 is such that, in a first switch position, which is shown in FIG. 1, it can connect the rail 5 to the rail 9 of the second secondary track 4. In corresponding manner, the length of the pivotable rail section 14 is such that it can connect the rail 6 of the main track 2 to a fixed intermediate rail section 16, as shown in FIG. 1.

In the second position of the switch 11, which is shown in FIG. 2, the rail 5 of the main track 2 is connected to the track 7 of the first secondary track 3 by way of the pivotable rail section 12; the rail 6 of the main track 2 is connected to a fixed intermediate rail section 17 by way of the pivotable rail section 14.

The pivotal movement of the two rail sections 12 and 14 between the two positions shown in FIGS. 1 and 2 is effected with the aid of an actuating mechanism, which is only shown schematically in FIGS. 1 and 2 and is provided as a whole with the reference numeral 18.

The pivotable rail section 12 is rigidly connected to a further pivotable rail section 21 by way of two cross-pieces 19, 20. This means that the pivotable rail section 21 is always pivoted together with the pivotable rail section 12 by the actuating device 18.

The pivotable rail section 21 is dimensioned such that, in the first position of the switch 11 as shown in FIG. 1, it can close the gap between the fixed intermediate rail section 16 and the rail 10 of the second secondary track 14. In the other position of the switch 11, which is shown in FIG. 2, this pivotable rail section 21 fills the gap between the fixed intermediate rail section 17 and the rail 8 of the first secondary track 3.

The inherently rigid arrangement of the pivotable rail section 12 and the pivotable rail section 21 is supported and guided in that end region which is remote from the joints 13, 15 by a stabiliser wheel 22 which, in turn, can run in a connecting guideway 23 which curves in a circular arc shape. The stabiliser wheel 22 is in turn mounted in a strut 24 which connects the two cross-pieces 19, 20 to one another.

In the exemplary embodiment described here, all movable parts are therefore activated together by a single actuating drive, namely the actuating mechanism 18. In terms of the control technology, this is particularly simple since the synchronism of the movement of all movable parts is ensured in this way. However, it is essentially also possible to provide a plurality of actuating mechanisms for different movable parts as seems expedient.

Figure 3:
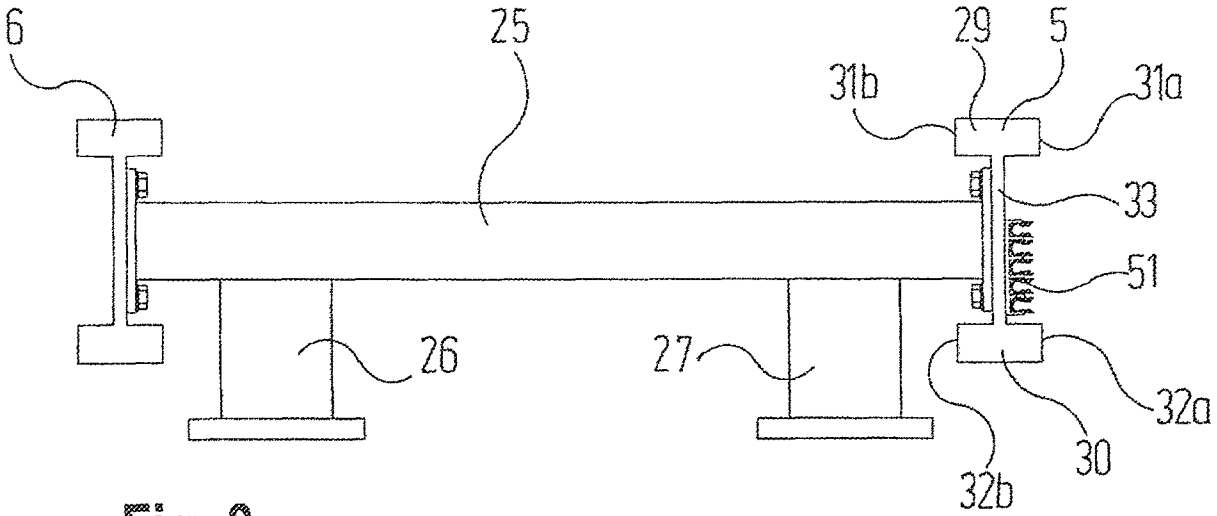
FIG. 3 a section through the rail system of FIGS. 1 and 2 according to line III-III of FIG. 1.
Figure 4:
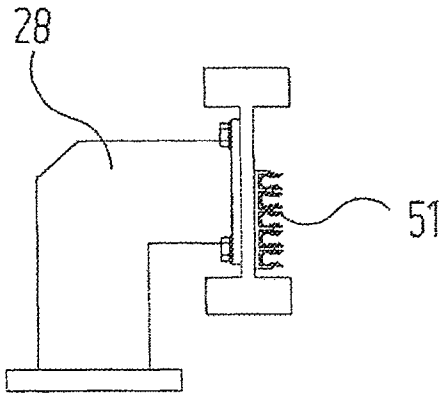
FIG. 4 a section through the rail system of FIGS. 1 and 2 according to line IV-IV of FIG. 1.

The rails 5 to 10 of the rail system 1 described here are I-shaped profiles, as shown in FIGS. 3 and 4. In the region of the main rail 2 and the two secondary rails 3, 4, these profiles are connected to one another at regular spacings by cross-pieces 25 which are in turn supported on the floor of the room by columns 26, 27. Unilateral supports 28, one of which is shown in FIG. 4, are used where it is not readily possible to connect opposing, mutually parallel-extending rails in this manner. Specific explanation of this FIG. 4 should not be necessary.

Figure 5:
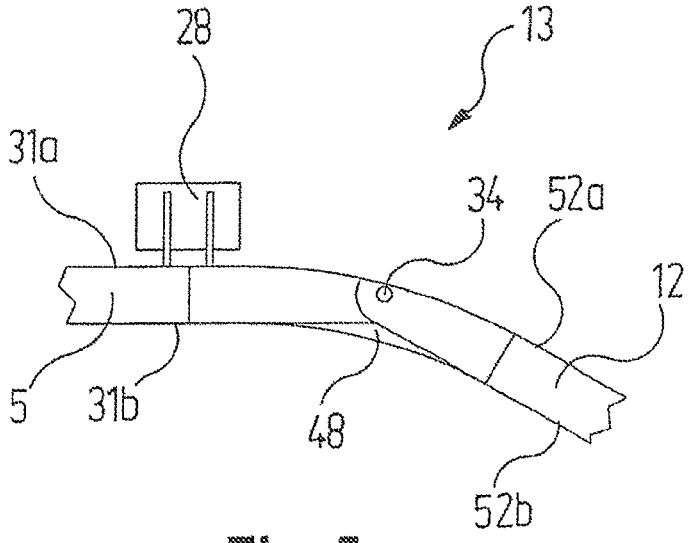
FIG. 5 the plan view on an enlarged scale of a joint which is used in the switch of the rail system, in a first position.
Figure 6:
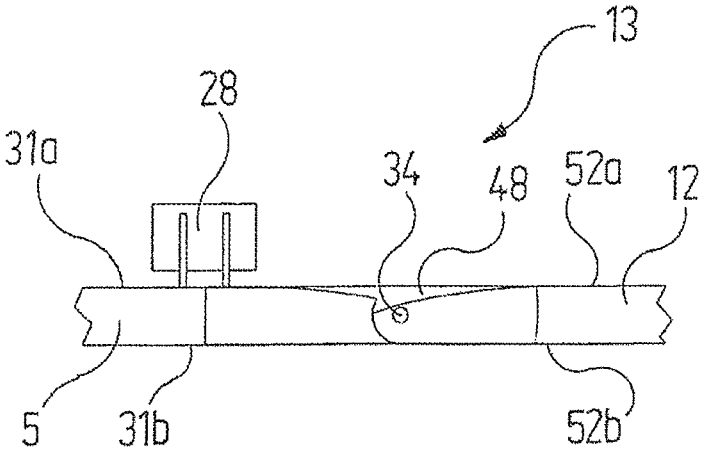
FIG. 6 a plan view of the joint in a second position.
Figure 7:
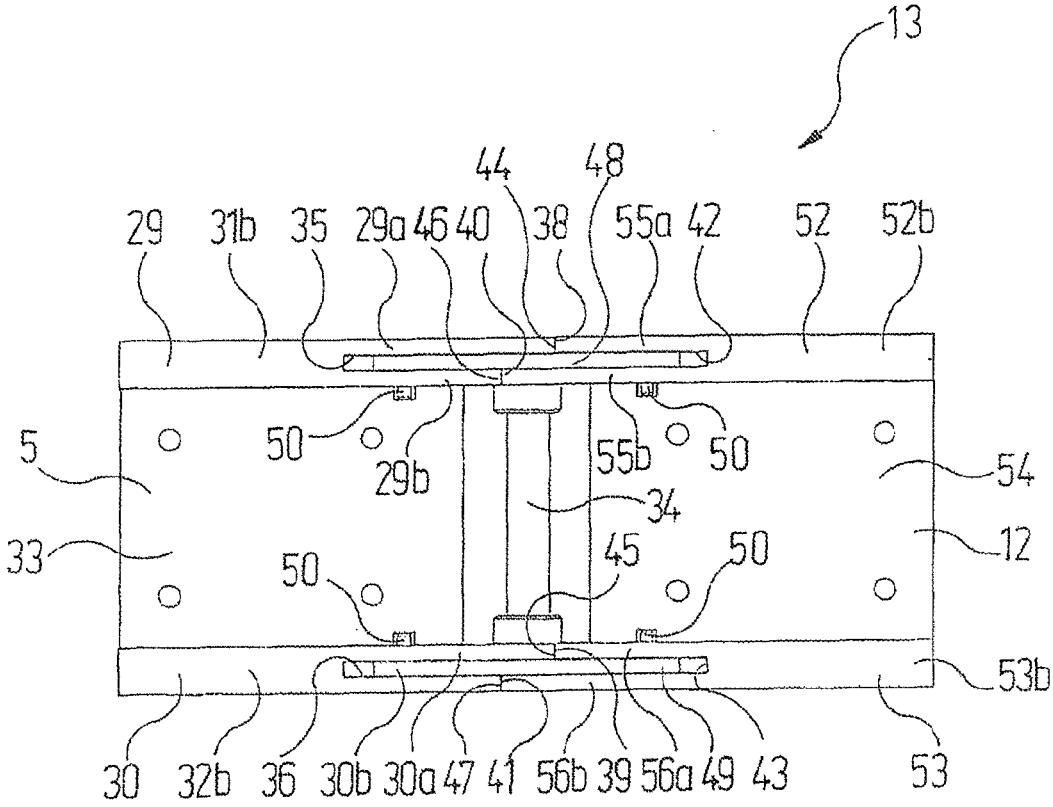
FIG. 7 the plan view of the joint of FIGS. 5 and 6.

To describe the joint 13 which connects the rail 5 of the main rail 2 to the pivotable rail section 12, reference is now made to FIGS. 5 to 7. The second joint 15, which connects the rail 6 of the main track 2 to the pivotable rail section 14, is constructed in the same way and therefore does not need to be described specifically.

The end regions of the rail 5 of the main track 2 and the pivotable rail section 12 of the switch 11 are shown again in FIGS. 5 to 7. On account of their I-profile, as shown in FIGS. 3 and 4, they both have an upper rail flange 29 and 52 and a lower rail flange 30 and 53. The upper and lower faces of the rail flanges 29, 30 and 52, 63 extend parallel to one another, generally horizontally. The upper faces of the upper rail flanges 29, 52 serve as running faces for drive and carrying rollers of an in-floor electric conveyor system (not shown) with a variable track width, which is known per se. The narrow vertical faces of the rail flanges 29, 30, 52, 53 form upper guide faces 31*a*, 31*b*, 52*a*, 52*b* and lower guide faces 32*a*, 32*b*, 53*a*, 53*b* for guide rollers of the vehicle.

The upper rail flanges 29, 52 and the lower rail flanges 30, 53 are in each case connected to one another in one piece by way of a web 33, 54. The web 33 of the rail 5 and the web 54 of the rail section 12 end, as shown in FIG. 7, at a spacing from a pivot pin 34 forming the axis of the joint 13. The manner of mounting the pivot pin 34 on the rail 5 and the rail section 12 will be clarified further below.

The rail flanges 29, 30 of the rail section 5 have a slot 35 and 36 in that end region which faces the pivotable rail section 12. The slots 35, 36 extend parallel to the upper and lower running faces of the rail flange 29, 30, i.e. perpendicularly to the lateral guide faces 31*a*, 31*b*. They extend over the entire width of the rail flanges 29, 30 and are open towards the lateral guide faces 31*a*, 31*b* and the end face 37 of the rail 5. The rail flanges 29 and 30 are therefore fork-shaped in the region of the end face 37 as seen from the side as in FIG. 7.

Those end faces of the flange regions 29*a*, 30*a* located above the slots 35, 36 which are facing the pivot pin 34 are provided with the reference numerals 38, 39, the end faces of the flange regions 29*b*, 30*b* located below the slots 35, 36 are provided with the reference numerals 40, 41.

Beyond the end faces 40, 41 of the lower flange regions 29*a*, 30*b*, the ends of the pivot pin 34 are guided through the respective upper flange regions 29*a*, 30*a* and mounted therein.

The end faces 38, 39 of the upper flange regions 29*a*, 30*a* are constructed as parts of a lateral face of a circular cylinder which is coaxial to the pivot pin 34 and are convex here as seen in the direction of the end faces 38, 39. The end faces 40, 41 of the lower flange regions 29*b*, 30*b* are likewise constructed as part of a lateral face of a second circular cylinder which is coaxial to the pivot pin 34 but are concave as seen in the direction of the end faces 40, 41.

The pivotable rail section 12 is constructed analogously to the fixed rail section 5. In particular, in their end region facing the fixed rail 5, the rail flanges 52, 53 are constructed in a complementary manner to the end region of the fixed rail 5. The pivot pin 34 is mounted in each case in the lower flange region 55*b* and 56*b* of the pivotable rail section 12.

The slots 35, 36 of the fixed rail 5 correspond to slots 42, 43 of the pivotable rail section 12, which in each case separate an upper flange region 55*a*, 56*a* from the lower flange region 55*b*, 56*b*.

The end faces 44, 45 of the upper flange regions 55*a*, 56*a* of the pivotable rail section 12 lie flat against the end faces 38, 39 of the fixed rail 5 in each pivotal position. Accordingly, the end faces 46, 47 of the lower flange regions 55*b*, 56*b* of the pivotable rail section 12 lie flat against the end faces 40, 41 of the fixed rail 5 in all pivotal positions.

When the pivotable rail section 12 is pivoted with respect to the fixed rail section 5, the mutually facing end faces slide along one another so that the upper and lower running and guide faces of the rail 5 and the rail section 12 merge into one another in practically seamless manner in all pivotal positions.

A respective elongated transition body in the form of an approximately box-shaped transition plate 48 and 49 is located in the slots 35, 36 of the fixed rail 5 and the slots 42, 43 of the pivotable rail section 12. The width of the transition plates 48, 49 perpendicularly to the direction of travel corresponds to the corresponding extent of the rail flanges 29, 30, 52, 53. With a linear arrangement of the rail sections 5, 12, as shown in FIGS. 2 and 6, the narrow longitudinal sides of the transition plates 48, 49 are flush with the lateral running faces 31*a*, 31*b*, 32*a*, 32*b*, 52*a*, 52*b*, 53*a*, 53*b* of the upper rail flanges 29, 52 and the lower rail flanges 30, 53.

The length of the transition plates 48, 49 in the direction of travel is less than the extent of the slots 35, 36, 42, 43 in this direction. Therefore, the transition plates 48, 49 do not abut against the end walls of the slots 35, 36, 42, 43 when the rail section 12 is pivoted.

The transition plates 48, 49 each have an elongated hole (not shown in the drawing) in the vicinity of their narrow end faces for a respective pintle 50. The pintles 50 are rotatable and displaceable in the elongated holes. The elongated holes extend parallel to the longitudinal sides of the transition plates 48, 49.

The axes of the pintles 50 extend parallel to the axis of the pivot pin 34. The pintles 50 are fastened in the corresponding lower flange regions 29*b*, 56*b* and upper flange regions 30*a*, 56*a*.

Approximately centrally, the transition plates 48, 49 each have a continuous pivot pin opening (likewise not shown in the drawing) through which the pivot pin 34 is guided. The pivot axis openings are dimensioned so that the pivot pin 34 does not abut against the edges of the pivot axis openings in any pivotal position of the pivotable rail section 12.

Upon a pivotal movement of the pivotable rail section 12, the transition plates 48, 49 are automatically pushed in the direction of the lateral guide face on the inner curve side as a result of the cooperation between the pintle 50 and the elongated holes. They thereby produce an alignment of the contours and smooth the transition between the lateral guide faces 31*a*, 31*b*, 32*a*, 32*b* of the fixed rails 5 on the inner curve side and the lateral guide faces 52*a*, 52*b*, 53*a*, 53*b* of the pivotable rail section 12.

FIGS. 5 and 6 show a peculiarity in the shape of the end regions of the rail 5 and the rail section 12. The upper lateral guide faces 31, 52*a* in FIG. 5 do not extend linearly as seen in plan view, but are both curved so that, in the pivotal position of the switch 11 shown in FIG. 5, they form a smooth, jolt-free and uniformly curved guide face for the guide rollers of the vehicle.

In the extended position of the switch 11 shown in FIG. 6, the lateral guide faces 31*a*, 32*a* of the rail 5 and the lateral guide face 52*a*, 53*a* of the rail section 12 in these end regions would themselves result in a discontinuity. However, the transition plates 48, 49 project laterally in this position so that, on the outside of the rail flange 29, 30, 52, 53, they ensure a smooth transition between the lateral guide faces 31*a*, 32*a* of the fixed rail 5 and the lateral guide faces 52*a*, 53*a* of the pivotable rail section 12.

Contact lines 51 extend along the rail 5 of the main track 2, over the pivotable rail section 12 and along the rail 7 of the first secondary track 3 and the rail 9 of the second secondary track 4, as shown in FIGS. 3 and 4. These contact lines serve to supply energy and/or transmit signals between the vehicles (not shown) of the in-floor electric conveyor system and a corresponding control and/or energy supply unit.

In the region of the transition between the fixed rail 5 and the pivotable rail section 12, these contact lines 50 have flexible connecting lines, for example in the form of copper braiding. These connecting lines are adapted to all possible pivotal movements and thus also enable continuous contact through the sliding contacts of the vehicle in the region of the transition.

As an alternative to a mechanical sliding connection between the sliding contacts of the vehicle and those on the rails, a contactless energy and/or signal transmission between cables, which are laid along the rails, and corresponding receivers of the vehicle are also possible.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A rail system for an in-floor electric conveyor system comprising:

a) a main track, which comprises at least two fixed parallel rails;

b) at least two secondary tracks which enclose an angle and each secondary track having as many fixed rails as the main track;

c) a switch arranged between the main track and the at least two secondary tracks, the switch comprising:

ca) a movable rail section for each fixed parallel rail of the main track, which is capable of forming at least part of a connection between the rail fixed parallel of the main track and a rail of the at least two secondary track in one position;

cb) at least one actuating mechanism for moving the movable rail sections;

wherein, d) each fixed parallel rail of the main track has a single movable rail section associated therewith, which is permanently physically connected to the rail of the main track via a joint and which is capable of being connected to a fixed rail of each secondary track through a pivotal movement about the joint, and wherein, e) each joint comprises ea) at least one end face of the fixed parallel rail of the main track, which is constructed as part of a rotational face about an axis of a pivot pin;

eb) at least one end face of the movable rail section which abuts against the end face of the fixed rail and is shaped in a complementary manner thereto;

ec) at least one transition body which overlaps the fixed rail and the movable rail section and is connected in one end region to the fixed rail and in an other end region to the movable rail section in articulated manner, wherein at least one end face of the transition body realises a contour-adapted transition between the fixed rail and the movable rail section in at least one position of the movable rail section.

2. A rail system according to claim 1, wherein the rotational face is a lateral face of a circular cylinder or a right circular cone.

3. A rail system according to claim 1, wherein at least one movable rail section is capable of forming a connection between the associated rail of the main track and the fixed intermediate rail sections associated with the secondary tracks, wherein the gaps between the respective fixed intermediate rail sections and the associated rails of the secondary tracks are capable of being closed by at least one further movable rail section.

4. A rail system according to claim 3, wherein the further movable rail section is rigidly connected to one of the movable rail sections which is connected to a fixed rail of the main track via a joint.

5. A rail system according to claim 1, wherein all movable rail sections are moved by way of a single actuating mechanism.

6. A rail system according to claim 1, wherein along at least one of the rails of the main track, along the movable rail section associated with said main track, and along at least one rail of each secondary track, lines are provided for supplying power to a vehicle travelling on the rail system and/or for transmitting signals from and/or to a vehicle travelling on the rail system.

7. A rail system for an in-floor electric conveyor system comprising:

a) a main track, which comprises at least two fixed parallel rails, each fixed rail having a fixed rail slot;

b) at least two secondary tracks which enclose an angle and each secondary track having as many fixed rails as the main track;

c) a switch arranged between the main track and the at least two secondary tracks, the switch comprising:

ca) a movable rail section for each fixed parallel rail of the main track, which is capable of forming at least part of a connection between the rail fixed parallel of the main track and a rail of the at least two secondary track in one position;

cb) at least one actuating mechanism for moving the movable rail sections;

wherein, d) each fixed parallel rail of the main track has a single movable rail section associated therewith, each single movable rail section having a movable rail slot which substantially aligns with the corresponding fixed rail slot, the single movable rail sections being permanently physically connected to the rail of the main track via a joint and which is capable of being connected to a fixed rail of each secondary track through a pivotal movement about the joint, and wherein, e) each joint comprises ea) at least one end face of the fixed parallel rail of the main track, which is constructed as part of a rotational face about an axis of a pivot pin;

eb) at least one end face of the movable rail section which abuts against the end face of the fixed rail and is shaped in a complementary manner thereto;

ec) at least one transition body positioned within each corresponding fixed rail slot and movable rail slot so that each transition body is connected at one end to the fixed rail and at an opposite end region to the movable rail section in articulated manner, so that each transition body forms a continuous rail edge on a first side of each corresponding fixed parallel rail and single movable rail section when the movable rail section connects the main track to a first of the at least two secondary tracks, and a continuous rail edge on a second side of each corresponding fixed parallel rail and single movable rail section when the movable rail section connects the main track to a second of the at least two secondary tracks.

8. A rail system according to claim 7, wherein the rotational face is a lateral face of a circular cylinder or a right circular cone.

9. A rail system according to claim 7, wherein at least one movable rail section is capable of forming a connection between the associated rail of the main track and the fixed intermediate rail sections associated with the secondary tracks, wherein the gaps between the respective fixed intermediate rail sections and the associated rails of the secondary tracks are capable of being closed by at least one further movable rail section.

10. A rail system according to claim 9, wherein the further movable rail section is rigidly connected to one of the movable rail sections which is connected to a fixed rail of the main track via a joint.

11. A rail system according to claim 7, wherein all movable rail sections are moved by way of a single actuating mechanism.

12. A rail system according to claim 7, wherein along at least one of the rails of the main track, along the movable rail section associated with said main track, and along at least one rail of each secondary track, lines are provided for supplying power to a vehicle travelling on the rail system and/or for transmitting signals from and/or to a vehicle travelling on the rail system.

* * * * *